US005611499A

United States Patent [19]

Stokes et al.

[11] Patent Number: 5,611,499

[45] Date of Patent: Mar. 18, 1997

[54] YARN TENSIONING DEVICE

[75] Inventors: David L. Stokes, Calhoun, Ga.; Michael R. Walker, Southern Pines, N.C.

[73] Assignee: Epic Enterprises, Inc., Southern Pines, N.C.

[21] Appl. No.: 580,135

[22] Filed: Dec. 28, 1995

[51] Int. Cl.[6] ..... B65H 59/22

[52] U.S. Cl. ..... 242/419.4; 242/150 R

[58] Field of Search ..... 242/150 R, 153, 242/154, 419.4, 419.5

[56] References Cited

U.S. PATENT DOCUMENTS

| | | | |
|---|---|---|---|
| 1,385,189 | 7/1921 | Pigeon | 242/150 R X |
| 1,534,264 | 4/1925 | Hanson | 242/150 R |
| 2,629,561 | 2/1953 | Heizer | 242/150 R X |
| 4,548,369 | 10/1985 | Bossart | 242/150 R |
| 4,572,459 | 2/1986 | Kamp et al. | 242/150 R |
| 5,191,847 | 3/1993 | Kojima et al. | 242/150 R X |

FOREIGN PATENT DOCUMENTS

| | | | |
|---|---|---|---|
| 1081450 | 12/1954 | France | 242/150 R |
| 550892 | 11/1956 | Italy | 242/150 R |
| 123713 | 12/1927 | Switzerland | 242/150 R |
| 175993 | 6/1935 | Switzerland | 242/150 R |
| 617425 | 8/1935 | Switzerland | 242/150 R |

*Primary Examiner*—Michael Mansen
*Attorney, Agent, or Firm*—Michael A. Mann, P.A.

[57] ABSTRACT

A yarn tensioning device 10 having three pairs of spring loaded tensioning disks 20 that exert an increasing incremental pressure on the yarn 12 which correlates to the tension in the yarn. The three pairs of tensioning disks 20 are mounted on the front side 42 of a bracket 40 around a post 90. The three posts 90 are coupled together on the back side 44 of the bracket 40 by a back plate 100. A threaded rod 108 is inserted through a center hole 48 in the bracket 40 and threadably engages the back plate 100, such that as the threaded rod 108 is rotated, the back plate 100 moves towards or away from the bracket 40. As the back plate 100 moves away from bracket 40 the posts 90 gets closer to the tensioning disks 20, thus increasing the amount of pressure exerted on the tension disks 20 by the springs 70. As the back plate 100 is moved closer to the bracket 40, the posts 90 get farther away from the bracket 40 and subsequently decrease the compression of the spring 70, thus reducing the amount of pressure exerted on the yarn 12. The tension in the yarn 12 can be adjusted by a color coded tool 130 which allows a technician to consistently adjust a number of devices 10 by referring to the color coded scale 132 and an indicator 136. The tool 130 allows a technician to simultaneously change the amount of pressure exerted on the yarn 12 by each pair of tension disks 20 by the mere rotation of one threaded rod 108, thus adjusting the incremental nature of the pressure the yarn 12 experiences.

20 Claims, 3 Drawing Sheets

YARN TENSIONING DEVICE

BACKGROUND OF THE INVENTION

1. Field of the Invention

The present invention relates to yarn tensioning devices. In particular, the present invention relates to a yarn tensioning device having three pairs of tension disks, each with different spring rates, so that the pressure the three pairs of tension disks exert on the yarn is singularly and simultaneously adjustable.

2. Discussion of Background

Yarn tensioning devices have been known in the art since at least 1919. (See U.S. Pat. No. 1,385,189 issued to Pigeon on Jul. 19, 1921.) During twisting or cabling operations, two strands of yarn are brought together and twisted or wrapped, thus forming a two-ply cabled yarn. Both ends of the yarn follow a different path until they meet in the twisting operation, but it is imperative that the tensions of each yarn be balanced during the cabling process in order to obtain a regular folded yarn. The end coming from the creel makes the balloon and determines the tension of the process. The tension of the yarn coming from the pot lid must then be regulated and controlled to match the tension of the creel yarn.

Various tensioning devices have been used in the art, having two and three pairs of discs to apply tension to the yarn or applying tension by magnetically controlled tensioning devices. However, each device in the prior art has had its deficiencies. The magnetic devices are too expensive to be a cost effective way of controlling the tension in the yarn coming from within the pot lid.

The prior art tensioning devices, having two or three pairs of tension discs, come in two basic forms. The first form is disclosed by Heizer in U.S. Pat. No. 2,629,561 which issued Feb. 24, 1953, and by Mackie, et al. in Italian Patent Number 550,892 which issued Nov. 10, 1956. In these patents, the inventors disclose a device having two pairs of tension discs that can both be adjusted at a single time. However, the pressure applied to the yarn by both of these tension discs is controlled by a single spring. Consequently, as it enters the tension discs, the yarn experiences the same pressure from each pair of disks, and inevitably the maximum pressure and subsequent tension on the yarn is applied by the first pair of disk it enters. For the yarn to experience its greatest pressure immediately upon entering the first disk may not have been a problem in the prior art, as the tensions experienced by the yarn only averaged 100 grams. The present cabling systems, however, operate with tensions sometimes in excess of 750 grams. As a result, if the yarn were to experience an immediate pressure that provided a tension of 750 grams, the yarn would bunch, or it is possible that its filaments would begin to separate and tear.

Therefore, it was necessary to provide a tensioning device that supplied the pressure needed to obtain the tension for today's operating parameters. A device constructed by Volkmann has three pairs of tension discs, each having different spring rates, that apply pressure to the discs such that the yarn experiences an incremental pressure as it is decelerated or tensioned sequentially by the three pairs of disks. However, as these devices are used in the manufacturing facilities, technicians are required to adjust and modify the tension applied by the devices. As a result, the tensioning devices become inconsistent over time when compared to each other. A tension device on one cabling system may provide tension to the yarn that is equal to the next, but the manner in which the tension is applied, i.e., the incremental nature, may be completely different. The first pair of disks in one tensioning device may apply 300 grams of tension, whereas the first pair in a second device may apply 100 grams, although both may apply a total of 700 grams of tension overall. Therefore, it was possible to have a cabling system that gave the appearance of operating in conformity with the next one, but which produced cabled yarn at different qualities due to the incremental nature of the pressure applied to the yarn.

Furthermore, when changing "runs," or the type of yarn that is cabled, different tensions must be applied to different type yarns. Therefore, when changing "runs," a technician is required to adjust the three tension posts individually, check the new settings with a tensiometer, and then repeat this step until the desired tension is found. It is common to have a number of cabling systems running side-by-side, each of which requires the same time-consuming operation of individually adjusting the three tension posts at each station. Additionally, during this operation a large amount of yarn is wasted, due to the fact that yarn is passing through the machine during each adjustment operation. Furthermore, because the discs rotate, broken or loose filaments tend to become entrapped in the device, causing wear and requiring additional labor to clean the device.

Therefore, there is a need for a tensioning device that applies incremental degrees of pressure to the yarn as the yarn is decelerated through the tensioning device. There is also a need for a tensioning device that maintains incremental degrees of pressure even after technicians have modified and adjusted the spring posts. Furthermore, there is a need for a tension device in which all of the tensioning posts are adjusted simultaneously, thus eliminating the possibility of changing the incremental nature of the pressure and providing a quicker and easier adjustment to the tensioning device, so that down time and wasted yarn between product "runs" is minimized.

SUMMARY OF THE INVENTION

According to its major aspects and broadly stated, the present invention is a tension device for a yarn cabling machine. A yarn cabling machine twists two ends of yarn together. The first end comes from a creel that enters a spindle at its bottom and then forms a balloon as it comes out. The second end of yarn comes from a package located on the spindle and comes out of a pot lid after running through an adjustable tension device, whereupon the two ends are twisted, thus forming a two-ply cabled yarn. The two ends of yarn must have an equal tension during the twisting process or a lower quality yarn will be produced; therefore, it is necessary to provide a tension device that is suitably adjustable.

The tension device is fitted into the top of the pot lid and comprises three pairs of spring loaded tension disks mounted on a bracket, wherein each pair of tension disks typically provides an incremental degree of pressure to the yarn as it is fed through the device. Each pair of tension disks provides a different degree of pressure to the yarn, so that as the yarn travels through the device, it experiences incremental tension from the pressure of each pair of tension disks it passes through. Incrementally greater pressure by the three springs is, however, not required in the present invention, but is preferred.

Each of the three pairs of tension disks comprises a first disk and an opposing second disk. The first disk is biased towards the second disk by a spring, and a post extends through the bracket on which the first and second disks are mounted along with the spring. Each of the three springs has a different spring rate, so that the first disk of each of the three pairs of tension disks exerts a different pressure onto the yarn that is proportional to the respective spring rate of each spring. The spring is secured onto the post so that it is biased against the first disk by a holder. A ceramic tube is inserted through the hole in the bracket and extends a short distance through to the front side of the bracket, so that when the yarn is traveling between the first and second disks, the yarn rides against the ceramic tube.

Each post of the three pairs of tension disks extends through the bracket and out the back side of the bracket. The three posts are coupled together by a back plate, preferably having a generally triangular shape. A threaded rod is inserted through a center hole in the bracket, so that it extends from the front side through to the back side. The threaded rod is threadably attached to the back plate, such that when the rod is rotated the back plate moves with respect to the bracket. Consequently, as the threaded rod is rotated and the back plate moved with respect to the bracket, the post of each pair of tension disks is moved, thus changing the position of the holder on each of the springs. By changing the position of the holder, each of the respective springs is either compressed or stretched, thus increasing or decreasing, respectively, the pressure applied to the yarn as it travels between the first and second disks. Therefore, as the threaded rod is rotated, the pressure exerted by each of the three pairs of tension disks is increased or decreased simultaneously, thus changing the tension in the yarn correspondingly.

The tension device also comprises a rubber ring and a foam ring. The rubber ring is positioned between the second disk and the front side of the bracket, and the foam ring is positioned between the spring and the first disk. The combination of the rubber ring and the foam ring prevents the first disk and the second disk from rotating as the yarn passes therebetween.

An adjustment tool is also provided to rotate the threaded rod on the tension device. The tool carries a color-coded scale that is used to provide a consistent degree of pressure by the three pairs of tension disks from tension device to tension device. In operation the tool is inserted until the tool engages the threaded rod. An indicator, which is spring loaded on the tool, engages the posts of each pair of tension disks and slides along color-coded scale of the tool to indicate the respective amount of pressure being exerted by the pairs of tension disks, and the respective amount of tension in the yarn.

A major feature of the present invention is the back plate which couples the posts of all three pairs of tension disks, thus allowing the pressure exerted on the yarn by each pair of tension disks to be changed simultaneously. By simultaneously changing the pressure exerted by the disks, a technician can change the tension in the yarn without having to make numerous adjustments to each pair of tension disks, thus saving time and reducing the amount of wasted yarn.

Another important feature of the present invention is the ability to simultaneously change the pressure exerted by each of the three pairs of tension disks merely by the rotation of a single threaded rod connected to the back plate. This feature enables a technician to change the tension of the yarn by rotating one rod, thus reducing the amount of time necessary to adjust the tension within the yarn.

Still another feature of the present invention is the ability to uniformly change the pressure exerted on the yarn by the rotation of a single threaded rod, while maintaining the incremental nature of the pressure exerted by each pair of tension disks. This is an important element of the present invention, because it prevents a technician from independently adjusting the pressure of each pair of disks. Consequently, the relative incremental increases in pressure the yarn experiences are maintained, irrespective of the total amount of pressure exerted on the yarn.

Yet another feature of the present invention is the tool with the color-coded scale and the indicator which indicates the amount of pressure being exerted on the yarn. The tool enables a technician to go from device to device and consistently adjust the pressure being applied to the yarn, which corresponds to the amount of tension in the yarn. The color-coded scale is visually easy for the technician to understand. Furthermore, when it is necessary to adjust a number of cabling machines, a technician need only find the color-code for the corresponding pressure, and then set all tension devices to the same position by visually observing the color scale. Consequently, the amount of yarn wasted during the tensioning process is minimized, along with the amount of time needed to change over a number of machines to a different tension amount corresponding to a different type of yarn.

An important advantage of the present invention is that the tension applied to the yarn can be set accurately and uniformly for any yarn cabling machine having the present tensioning device and tool combination by simply rotating the threaded rod using the tool until the indicator on the tool is at the preselected point on the scale. Therefore, different machines can be easily set to produce yarn having the same tension. Yarn tension will become more easily reproducible by the same and different machines, and can be set to standards for yarn products of overall more uniform quality.

Other features and advantages of the present invention will be apparent to those skilled in the art from a careful reading of the Detailed Description of a Preferred Embodiment presented below and accompanied by the drawings.

DETAILED DESCRIPTION OF PREFERRED EMBODIMENTS

Referring now to the Figures, the present invention is a yarn tensioning device 10 having three pairs of tension disks 20 which act in combination to decelerate or brake a length of yarn 12 as it passes through device 10, so that a pressure is exerted onto yarn 12. Yarn 12 is being pulled through device 10 at a given constant rate, and thus, device 10 exerts a pressure onto yarn 12 to decelerate yarn 12 as it enters device 10, thus giving yarn 12 a desired tension value.

Figure 4:
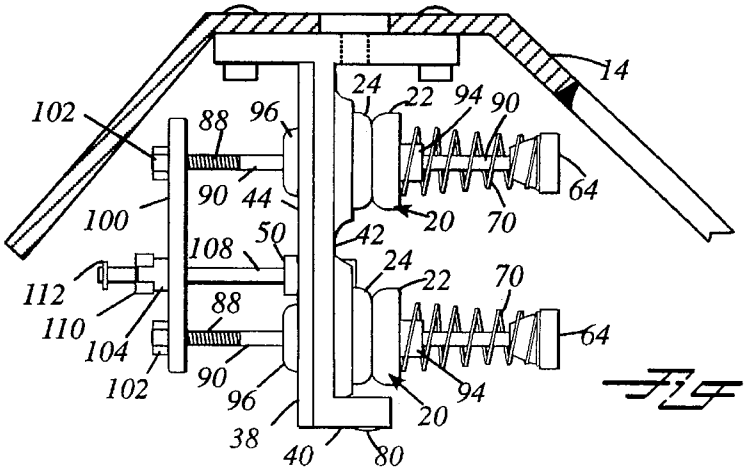
FIG. 4 is a side view of a yarn tensioning device within a pot lid, showing the top portion of the pot lid, according to a preferred embodiment of the present invention.

Yarn tensioning device 10 comprises a bracket 40 on which three pairs of tension disks 20 are mounted. Each of three pairs of tension disks 20 is similar in construction except as will be noted below; therefore, only one description of three pairs of tension disks 20 will be given. Bracket 40 is designed to be mounted within a pot lid 14 of a typical cabling system, as best seen in FIG. 4. The mounting method of bracket 40, as will be discussed in detail below, can be for a Volkmann, Verdol, ICBT or other style cabling machine.

Three pairs of tension disks 20 comprise a first disk 22 and a second disk 24. Each disk 22 and 24 has a rounded edge 26 to facilitate thread up, as depicted in FIGS. 2, 4, 5, and 7, and can be constructed from a ceramic or possibly be chrome plated. Those skilled in the art will recognize that the exact design of disks 22 and 24 and material of disks 22 and 24 can be modified and still remain within the scope of this disclosure. Disks 22 and 24 should be designed to provide a smooth contact surface for yarn 12 to ride against. Additionally, disks 22 and 24 should be constructed from a material that will reduce the friction generated by yarn 12 passing between disks 22 and 24, and a material that will not impart abrasions to yarn 12.

Three posts 90 each extend from the front side 42 of bracket 40 through a hole 46 in bracket 40 to the back side 44 of bracket 40. A ceramic tube 94 having a collar 96 and an inner passage 98 is inserted in bracket 40 from back side 44 through hole 46 to front side 42, until collar 96 engages back side 44. Post 90 extends through bracket 40 through inner passage 98 of ceramic tube 94. As stated above, ceramic tube 94 is inserted through hole 46 until collar 96 engages back side 44 of bracket 40. Ceramic tube 94 is also glued into position in hole 46, so that ceramic tube 94 will not rotate or come loose in hole 46. Post 90 is slidably mounted within inner passage 98 of ceramic tube 94, so that post 90 is free to slide within passage 98, but inner passage 98 is small enough that post 90 will not wobble or rattle.

On front side 42 of bracket 40, first disk 22 and second disk 24 are mounted on post 90 and ceramic tube 94, so that second disk 24 is closer to bracket 40 than first disk 22. Furthermore, first disk 22 and second disk 24 are positioned to face each other, thus providing a smooth contact surface for yarn 12 as it passes therethrough.

A rubber ring 60 is positioned between second disk 24 and front side 42 of bracket 40 around ceramic tube 94, so that second disk 24 is inhibited from rotating due to the contact between second disk 24 and rubber ring 60. A foam ring 62 is positioned adjacent to first disk 22, around post 90 and ceramic tube 94, so that foam ring 62 is farther away from front side 42 of bracket 40 than first disk 22. A spring 70 is positioned around post 90 with a holder 64 securing spring 70 in place, such that spring 70 imparts a force or bias onto first disk 22, thus urging first disk 22 towards second disk 24. Spring 70 is positioned so that ceramic tube 94 extends into the center of spring 70. Consequently, ceramic tube 94 extends through rubber ring 60, first and second disk 22 and 24, and foam ring 62, and extends partially into the interior of spring 70.

Holder 64 is attached to post 90, so that holder 64 will not rotate, but will maintain spring 70 in engagement with first disk 22. In the present invention, post 90 is a hex-head cap screw with the hexagonal head 92 which engages a counter bore 66 in holder 64, thus securing holder 64 in place and preventing holder 64 from rotating.

Each of three pairs of tension disks 20 on device 10 are constructed as described above; however, spring 70 may have a different spring rate for each pair of tension disks 20. Spring 70 is a compression spring having a first end 72 and a second end 74 such that the diameter of spring 70 at first end 72 is smaller than the diameter of spring 70 at second end 74. First end 72 of spring 70 engages holder 64, and second end 74 of spring 70 engages foam ring 62 and first disk 22. Spring 70 is held in a compressed state by holder 64, such that as holder 64 moves closer to front side 42 of bracket 40, spring 70 is compressed, and as holder 64 moves away from front side 42 of bracket 40, spring 70 is decompressed. This movement of holder 64 is controlled by the movement of post 90 sliding within ceramic tube 94, as will be discussed in detail below. Consequently, as post 90 slides within ceramic tube 94, holder 64 moves, thus correspondingly compressing or decompressing spring 70. Therefore, as post 90 moves and spring 70 is compressed or decompressed, the pressure exerted on yarn 12 as it passes between first disk 22 and second disk 24 is correspondingly changed.

As stated above, each spring 70 for each pair of tension disks 20 may have a different spring rate. The spring rates are preferably selected and the springs adjusted so that yarn 12 experiences the least amount of pressure from the pair of tension disks 20 yarn 12 first encounters. The next pair of tension disks 20 yarn 12 encounters, should impart an increased amount of pressure to yarn 12, and the last pair of tension disks 20 yarn 12 encounters should impart the greatest amount of pressure onto yarn 12, as compared to the other two. The total amount of pressure that is imparted onto yarn 12 is directly proportional to the amount of tension in yarn 12. Basically, as yarn 12 is being drawn through device 10, with yarn 12 experiencing an incremental pressure increase by each pair of tension disks 20, device 10 will brake or decelerate yarn 12, thus increasing the tension on yarn 12. Those skilled in the art will recognize that spring 70 may be modified or substituted by any device that imparts a bias to first disk 22. Furthermore, it should be understood that the pressure applied by each spring 70 may be uniform if desired without departing from the spirit of the present invention. However, it is believed that the pressure should not only increase from spring to spring but should increase nonlinearly for best results. The present invention makes adjusting the total pressure easier while still preserving the ratio of pressures among the three springs.

Figure 1:
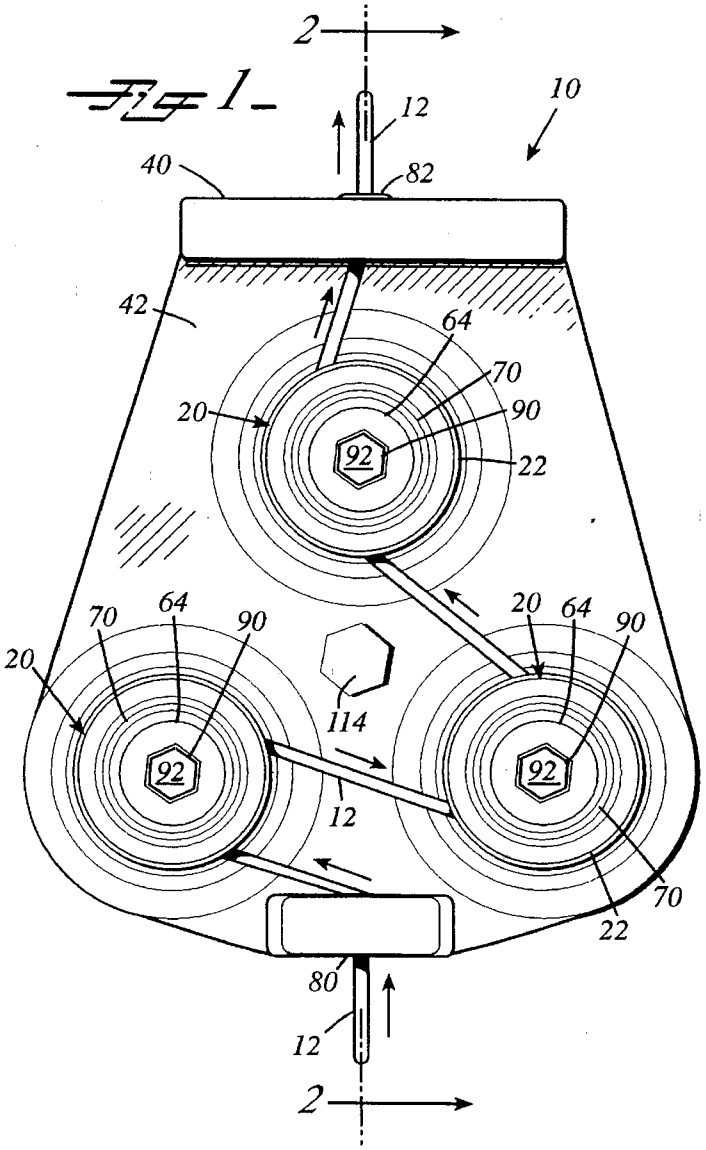
FIG. 1 is a front view of a yarn tensioning device according to a preferred embodiment of the present invention.
Figure 2:
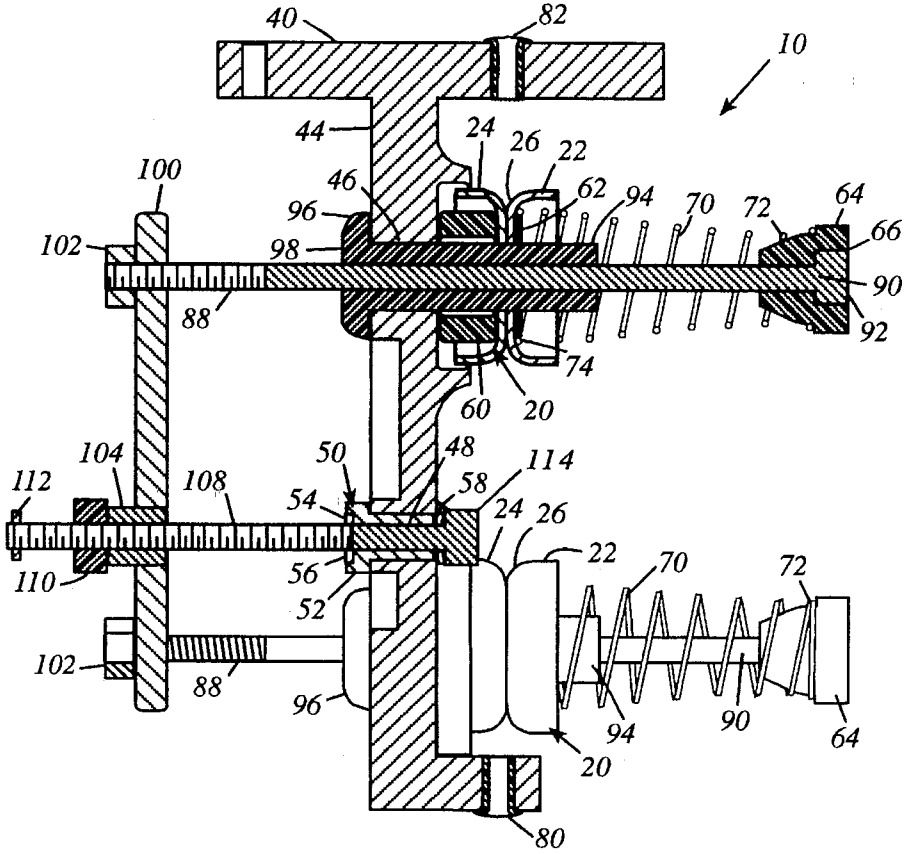
FIG. 2 is a cross-sectional view of a yarn tensioning device taken along line 2—2 of FIG. 1 according to a preferred embodiment of the present invention.

Yarn 12 enters device 10 through a first ceramic insert 80 positioned on the bottom of front side 42 of bracket 40. Yarn 12 then makes its way through each pair of tension disks 20, as shown in FIG. 1 and as described above, until it leaves device 10 near the top of front side 42 of bracket 40 through a second ceramic insert 82. Ceramic inserts 80 and 82 and ceramic tube 94 are used in the preferred embodiment, so that yarn 12 does not tear or rip as yarn 12 travels and is decelerated through device 10. Those skilled in the art will recognize that other types of inserts 80 and 82 or tubes 94, or even the material of disks 22 and 24, could be changed or substituted for another suitable and still remain within the scope of this disclosure.

Each of three posts 90 has a threaded end 88 which is coupled together by a back plate 100. Threaded ends 88 of posts 90 extend through back plate 100 and are secured by lock nuts 102. Back plate 100 is secured at a perpendicular angle compared to each of posts 90, so that by moving one of posts 90 each of the other posts 90 are moved uniformly.

Consequently, if the pressure exerted by one pair of tension disks 20 is changed, the pressure exerted by the other two pairs of tension disks 20 are uniformly and simultaneously changed.

In the preferred embodiment, bracket 40 has a center hole 48 that extends through bracket 40. A bushing 50 having a cap 52 is inserted into hole 48 from back side 44 of bracket 40, until cap 52 engages back side 44 of bracket 40. In the preferred embodiment, bushing 50 is constructed from a type of steel and is typically press-fitted into center hole 48. Those skilled in the art will recognize that bushing 50 can be constructed from other types of material, including plastic, and that there are other methods of securing bushing 50 into hole 48, including welding or gluing. A threaded rod 108 having a head 114 is inserted through bushing 50 in center hole 48 in bracket 40, until head 114 is proximate to front side 42 of bracket 40. A wave washer 58 is positioned around threaded rod 108 so that it is located between head 114 and front side 42 of bracket 40.

Bushing 50 has a counterbore 54 in cap 52 in which a first retaining ring 56 is inserted around threaded rod 108. The combination of first retaining ring 56 and wave washer 58 act to securely hold head 114 of threaded rod 108 proximate to front side 42 of bracket 40. Wave washer 58 pushes against head 114 and front side 42 of bracket 40, thus keeping threaded rod 108 tightly positioned in bushing 50.

A threaded insert 104 is positioned on back plate 100 so that it is aligned with threaded rod 108. In the preferred embodiment of the present invention, threaded insert 104 extends through back plate 100 and is welded to back plate 100; however, those skilled in the art will recognize that threaded insert 104 may be constructed and attached to back plate 100 in a variety of ways without departing from the spirit and scope of the present invention.

Threaded insert 104 has a U-shaped end with a pair of shoulders 106. A sleeve 110 is located between shoulders 106, so that sleeve 110 is prevented from rotating by shoulders 106. The main purpose of sleeve 110 is to function similar to a lock washer, thus preventing threaded rod 108 from rotating merely due to the vibrations of device 10. Consequently, in the preferred embodiment during the construction of device 10 sleeve 110 is constructed from a plastic having a center through-hole. The through-hole is not threaded, so that during construction of device 10, threaded rod 108 is inserted through sleeve 110, thus forming a threaded portion as it extends through sleeve 110. This method of construction enhances the function of sleeve 110 as a lock washer for threaded rod 108. Additionally, a second retaining ring 112 is positioned about threaded rod 108, as far away as feasible from back side 44 of bracket 40. Second retaining ring 112 acts as an end stop for back plate 100, thus preventing back plate 100 from moving away from bracket 40 more than a predesigned position.

In operation, the turning or rotation of threaded rod 108 causes back plate 100 to move either closer or farther in distance from bracket 40. As back plate 100 moves away from bracket 40 posts 90, which are coupled to back plate 100, move simultaneously. The movement of posts 90 when back plate 100 is moved away from bracket 40, as described above, moves holders 64 closer to first disks 22, thus compressing spring 70 which in turn increases the pressure exerted on yarn 12. Conversely, when back plate 100 is moved closer to bracket 40 by the rotation of threaded rod 108, holders 64 are moved away from first disks 22, thus decompressing spring 70, which reduces the amount of pressure exerted on yarn 12 by tension disks 20. Furthermore, the increase or decrease in pressure exerted on yarn 12 will correspondingly increase or decrease the amount of tension in yarn 12.

In the preferred embodiment, threaded rod 108 has a left-handed thread which will increase the amount of pressure exerted on yarn 12 when threaded rod 108 is rotated clockwise, which is likely the normal inclination of the technician. By rotating threaded rod 108 counter-clockwise, the pressure exerted on yarn 12 will be reduced. Those skilled in the art will recognize that changes to threaded rod 108, sleeve 110, and threaded insert 104 could be made without departing from the spirit of the present invention.

Device 10 can be attached to pot lid 14 in a variety of ways depending on the type of cabling system being used. In FIG. 4, device 10 is attached to pot lid 14 by a plurality of screws and nuts. For other types of machines, device 10 may actually be connected to pot lid 14 proximate to second ceramic insert 82. In this type of machine, second ceramic insert 82 will be threaded on its exterior so that device 10 may be screwed to the lid of pot lid 14. Numerous methods of mounting devices, including those described above, are contemplated by this disclosure, and thus those described should not be construed as limiting, but merely an illustration of different examples.

Bracket 40 also has a series of ridges 38 along its back side 44. Ridges 38 are used to give bracket 40 more structural strength and to reduce fatigue. Those skilled in the art will recognize that the varying configurations of ridges 38 may be used to enhance the structural strength of bracket 40.

Figure 7:
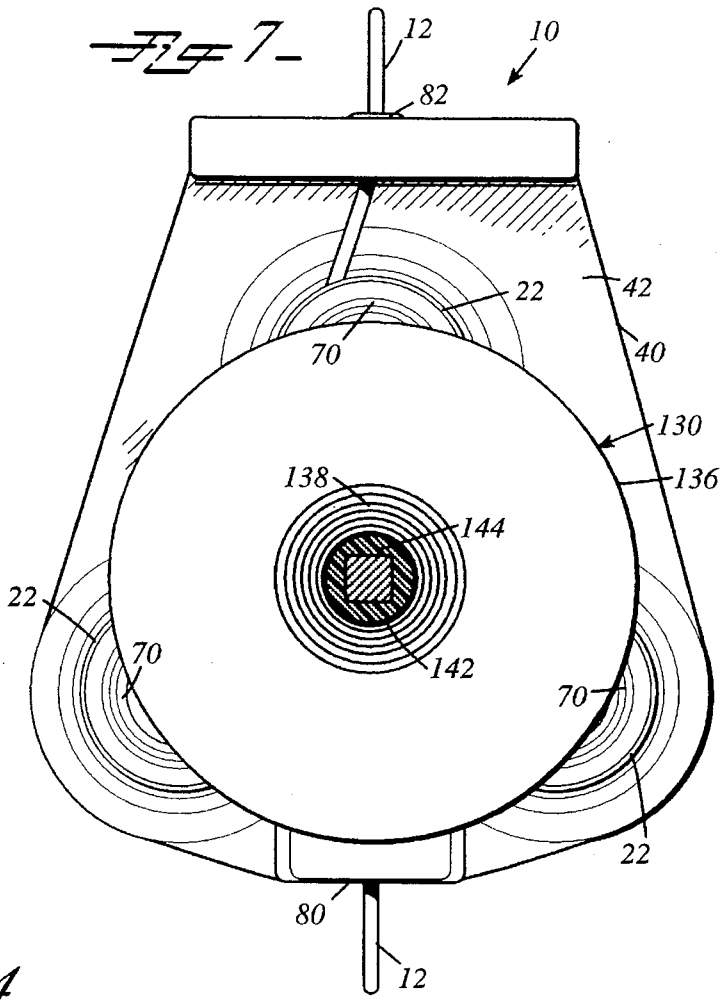
FIG. 7 is a front view of a yarn tensioning device with an adjustment tool in operation, with the handle of the tool removed for clarity according to line 7—7 in FIG. 5, according to a preferred embodiment of the present invention.
Figure 3:
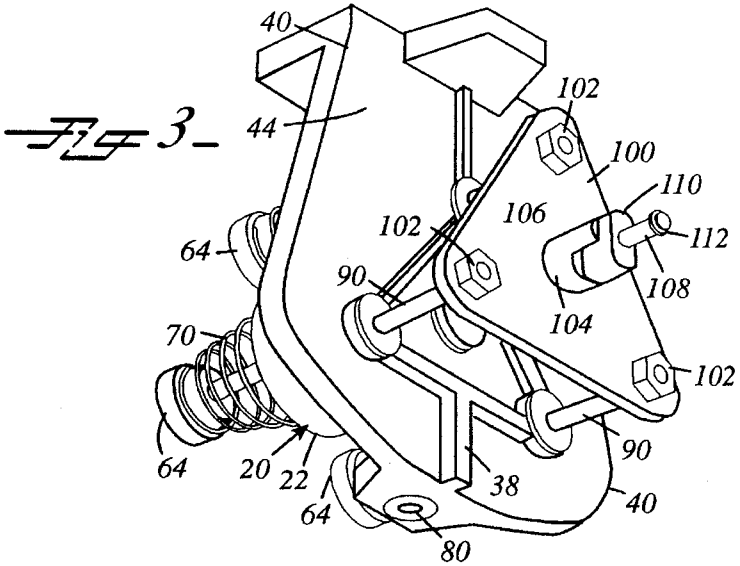
FIG. 3 is a perspective view from the back side of the bracket of a yarn tensioning device according to a preferred embodiment of the present invention.
Figure 5:
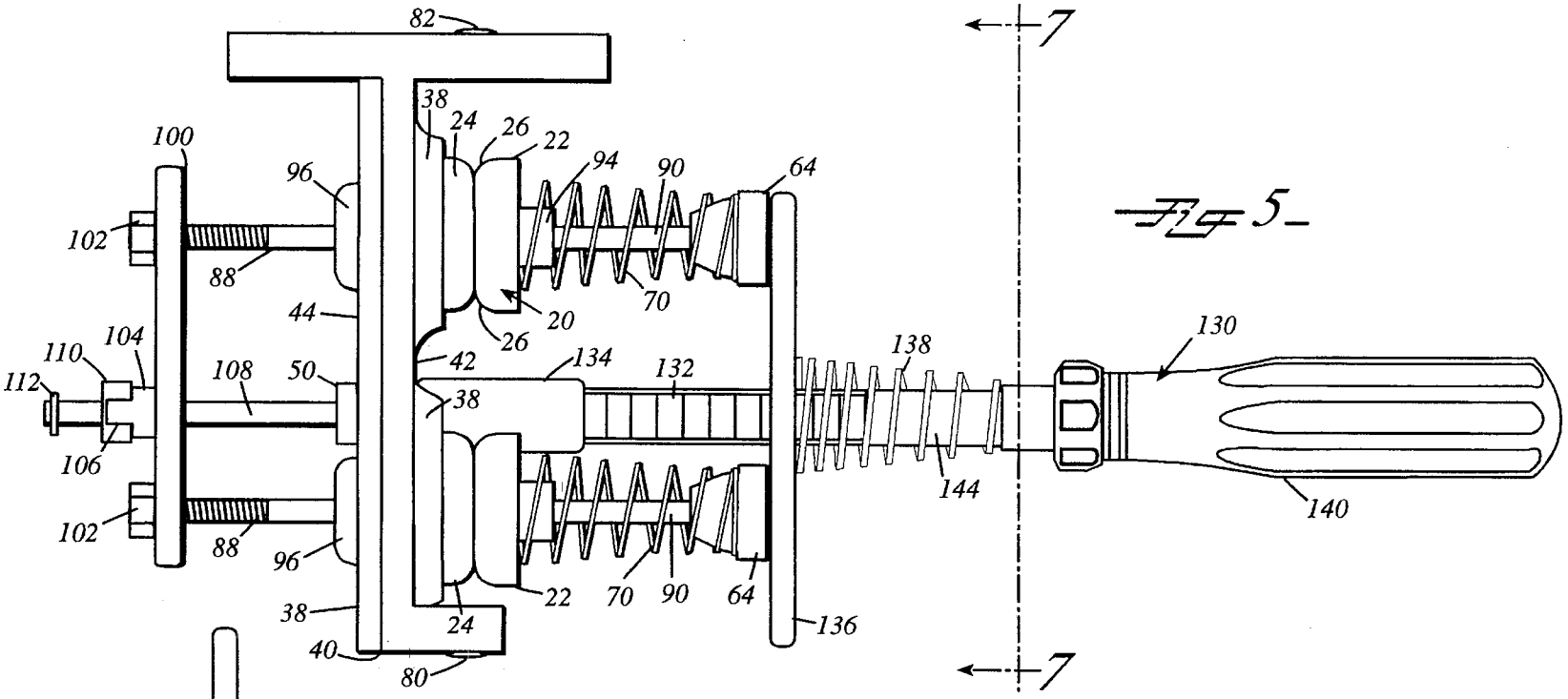
FIG. 5 is a side view of a yarn tensioning device with an adjustment tool in operation according to a preferred embodiment of the present invention.
Figure 6:
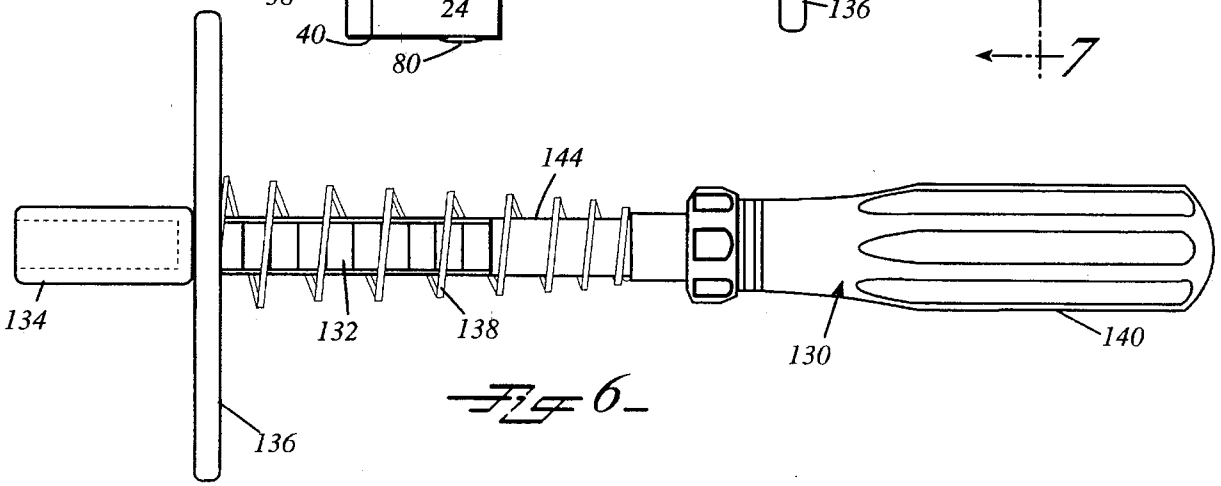
FIG. 6 is a side view of an adjustment tool according to a preferred embodiment of the present invention.

In FIGS. 5, 6 and 7, an adjustment tool 130 is depicted in operation with device 10 and by itself, respectively. Tool 130 comprises a handle 140 and a shaft 144 which carries a color coded scale 132. At the end of shaft 144 is a socket head 134 which is able to engage head 114 of threaded rod 108. A circular indicator 136 having a hole 142 in its center is slidably positioned on shaft 144, so that indicator 136 slides over scale 132. Indicator 136 is biased toward socket head 134 by a spring 138 carried around shaft 144. Indicator 136 is able to slide over shaft 144 and scale 132 when a pressure is applied to indicator 136, thus counteracting the force or bias of spring 138.

In the operation of tool 130, as best seen in FIG. 5, a technician positions tool 130 so that socket head 134 engages head 114 of threaded rod 108. In this position, indicator 136 will also engage the surface of holders 64 and hexagonal head 92 of posts 90. As tool 130 is put into engagement with head 114, indicator 136 slides down shaft 144, over scale 132 until the engagement. Consequently, the position of indicator 136 on shaft 144 and scale 132 is determined by the distance shaft 144 must be inserted into device 10. This distance is proportional to the distance from back plate 100 to bracket 40. Therefore, the closer back plate 100 is to bracket 40, the farther along shaft 144 and scale 132, indicator 136 will be positioned. The farther back plate 100 is away from bracket 40, the closer indicator 136 will be to socket head 134.

Those skilled in the art will recognize that other configurations of head 114 and socket head 134 can be made without departing from the scope of this disclosure. For example, head 114 could be configured with a socket head, flat head, phillips head, or any other suitable type head that would allow socket head 134 or its respective configuration to engage and rotate threaded rod 108.

Those skilled in the art will also recognize that color coded scale 132 could be applied to tensioning device 10 rather than shaft 144 of tool 130. For example, scale 132 could be applied to any one or all posts 90, thus showing their position with respect to bracket 40. Post's 90 position with respect to bracket 40 is directly proportional to the amount of pressure exerted on yarn 12, and thus the amount of tension in yarn 12. Furthermore, those skilled in the art will recognize a color coded scale is not necessarily required and that other types of scales or other types of indicia could be used to set the tension in yarn 12. For example, a numeric or alphanumeric scale could be used without departing from the teachings of the present invention.

Tool 130 is disclosed with a handle 140 to turn threaded rod 108. However, it is contemplated that an electric or other mechanical means, including a rotary actuator, drill, or speed wrench, may be used in place of handle 140. This substitution would reduce the physical labor necessary to rotate threaded rod 108. Those skilled in the art will recognize that this substitution can be made without departing from the spirit of this disclosure.

Those skilled in the art will recognize that the pressure exerted on yarn 12 and subsequent tension experienced by yarn 12 can be controlled by the adjustment of threaded rod 108 by tool 130. The position of indicator 136 with respect to scale 132 will be indicative of the pressure exerted on yarn 12 and the tension in yarn 12. Therefore, a technician, once determining the desired amount of tension on yarn 12 in correlation to the position of indicator 136 on scale 132, can consistently and quickly adjust a number of cabling machines having a tensioning device. The use of tensioning device 10 and tool 130 can reduce the amount of time it takes a technician to change the tension in a number of devices. This will also reduce the amount of wasted yarn which is usually wasted during each tensioning process. Furthermore, the range of pressure exerted on yarn 12 by each pair of tension disks 20 can be adjusted by a technician simultaneously without changing the incremental increase of pressure in each of tension disks 20.

In summary, with the use of yarn tensioning device 10, yarn 12 changes on a series of cabling machines require new tension settings for the whole frame, and are done rapidly with almost no yarn waste and virtually no fouling of tensioning device 10. To reset the tensions, a technician chooses one frame position for the test adjustment. A single adjustment resets all three posts 90 equally and evenly. The only yarn 12 loss that occurs is on this one test position. Once the correct tension is found, corresponding to the pressure exerted on yarn 12 by tensioning disks 20, adjustment tool 130 allows all the other positions on the frame to be rapidly and evenly set to the same color-coded tension setting, corresponding to the position of indicator 136 on scale 132.

It will be apparent to those skilled in the art that many changes and substitutions can be made to the preferred embodiment herein described without departing from the spirit and scope of the present invention as defined by the appended claims.

What is claimed is:

1. A system for tensioning yarn, said system comprising:

bracket having a front side and a back side;

three pair of disks carried by said front side of said bracket, each pair of disks of said three pairs of disks having a first disk and an opposing second disk;

three posts extending from said front side of said bracket through to said back side of said bracket, said each pair of disks having one post of said three posts extending therethrough;

three springs applying biases to said three pairs of disks so that said first disk and said second disk of said each pair of disks are urged together, said each pair of disks having one spring of said three springs applying said bias thereto;

three holders carried by said three posts, each holder of said three holders engaging one spring of said three springs so that said biases of said three springs are adjustable by the movement of said three holders and said three posts relative to said front side of said bracket;

means carried by said three posts for coupling said three posts together, so that the movement of said coupling means relative to said back side of said bracket changes said biases applied by said three springs; and means connected to said coupling means for moving said coupling means relative to said bracket, said moving means extending through said bracket to said front side so that from said front side of said bracket, said biases of said three springs may be changed when said moving means moves said coupling means.

2. The system as recited in claim 1, wherein when said coupling means is moved away from said back side of said bracket, said biases applied by said three springs increase, and when said coupling means is moved closer to said back side of said bracket, said biases applied by said three springs decrease.

3. The system as recited in claim 1, wherein said coupling means comprises a back plate, said each post of said three posts extending through and secured to said back plate.

4. The system as recited in claim 1, wherein said coupling means comprises a back plate, said each post of said three posts extending through said back plate, said each post secured to said back plate by a lock nut, said back plate having a threaded insert; and wherein said moving means comprises a threaded rod having a head thereon, said threaded rod extending through said bracket into engagement with said threaded insert on said back side of said bracket, said head of said threaded rod positioned on said front side of said bracket so that said back plate may be moved relative to said bracket by the rotation of said threaded rod from said front side of said bracket.

5. The system as recited in claim 4, wherein said threaded insert has a U-shaped end with a pair of shoulders having a sleeve positioned therebetween, said sleeve locking said threaded rod.

6. The system as recited in claim 1, wherein said moving means comprises a threaded rod having a head, said threaded rod extending through said bracket wherein said head is positioned on said front side of said bracket, said threaded rod engaging said coupling means such that the rotation of said threaded rod moves said coupling means relative to said back side of said bracket.

7. The system as recited in claim 1, wherein said each spring of said three springs has a different spring rate.

8. The system as recited in claim 1, wherein said each spring of said three springs has a different spring rate, such that as the yarn passes between said each pair of disks the pressure exerted on the yarn by said each pair of disks increases as the yarn passes through said three pairs of disks.

9. A system for tensioning yarn, said system comprising:

a bracket having a front side and a back side;

at least two pairs of disks carried by said front side of said bracket, each pair of disks of said at least two pairs of disks having a first disk and an opposing second disk;

at least two posts extending from said front side of said bracket through to said back side of said bracket, said each pair of disks having one post of said at least two posts extending therethrough;

at least two springs applying biases to said at least two pairs of disks so that said first disk and said second disk of said each pair of disks are urged together, said each pair of disks having one spring of said at least two springs applying said bias thereto;

at least two holders carried about said at least two posts, each holder of said at least two holders engaging one spring of said at least two springs so that said biases of said at least two springs are adjustable by the movement of said at least two holders and said at least two posts;

means carried by said at least two posts for coupling said at least two posts together, so that the movement of said coupling means relative to said back side of said bracket changes said biases applied by said at least two springs;

a threaded rod having a head, said threaded rod extending from said front side of said bracket through said bracket and threadably engaging said coupling means with said head positioned on said front side of said bracket, said threaded rod moving said coupling means relative to said bracket when said threaded rod is turned, thus changing said biases applied by said at least two springs; and means for turning said threaded rod, said turning means engaging said head of said threaded rod, so that by turning said turning means said biases applied by said at least two springs are changed.

10. The system as recited in claim 9, wherein said turning means comprises a scale and an indicator slidably mounted on said scale, said scale marked with indicia corresponding to said biases applied by said at least two springs, said indicator indicating the pressure being applied to the yarn as the yarn passes between said first and said second disks of said at least two pairs of disks by its relative position on said scale, said indicator moving relative to said scale in response to the rotation of said threaded rod by said turning means.

11. The system as recited in claim 10, wherein said scale is color coded.

12. The system as recited in claim 10, wherein said indicator engages said at least two holders when said turning means is in engagement with said head of said threaded rod.

13. The system as recited in claim 9, wherein when said coupling means is moved away from said back side of said bracket, said biases applied by said at least two springs increase, and when said coupling means is moved closer to said back side of said bracket, said biases applied by said at least two springs decrease.

14. The system as recited in claim 9, wherein said coupling means comprises a back plate, said each post of said at least two posts extending through and secured to said back plate.

15. A system for tensioning yarn, said system comprising:

a bracket having a front side and a back side;

a first pair of disks positioned on said front side of said bracket, said first pair of disks having a first disk and an opposing second disk;

a second pair of disks positioned on said front side of said bracket, said second pair of disks having a first disk and an opposing second disk;

a first post extending through said first pair of disks and through said bracket from said front side to said back side;

a second post extending through said second pair of disks and through said bracket from said front side to said back side;

a first spring applying a first bias to said first disk of said first pair of disks to urge said first disk of said first pair of disks against said second disk of said first pair of disks;

a second spring applying a second bias to said first disk of said second pair of disks to urge said first disk of said second pair of disks against said second disk of said second pair of disks;

a first holder carried about said first post and engaging said first spring so that as the relative position of said first holder to said front side of said bracket changes, said first bias applied by said first spring changes;

a second holder carried about said second post and engaging said first spring so that as the relative position of said first holder to said front side of said bracket changes, said second bias applied by said second spring changes;

a back plate positioned proximate to said back side of said bracket, said first post and said second post extending through said back plate and secured therethrough, said back plate coupling said first post and said second post so that as said back plate moves relative to said back side of said bracket, said first and said second biases applied by said first spring and said second spring, respectively, change uniformly and simultaneously; and a threaded rod having a head thereon, said threaded rod extending through said bracket and threadably engaging said back plate, said head of said threaded rod positioned on said front side of said bracket, so that by rotating said threaded rod the relative position of said back plate relative to back side of said bracket changes.

16. The system as recited in claim 15, further comprising means for turning said threaded rod, said turning means engaging said head of said threaded rod, so that by turning said turning means said first bias and said second bias are uniformly and simultaneously changed.

17. The system as recited in claim 16, wherein said turning means comprises a scale and an indicator slidably mounted on said scale, said scale marked with indicia corresponding to said biases applied by said at least two springs, said indicator indicating the pressure being applied to the yarn as the yarn passes between said first and said second disks of said first pair of disks and said first disk and said second disk of said second pair of disks by its relative position on said scale, said indicator moving relative to said scale in response to the rotation of said threaded rod by said turning means.

18. The system as recited in claim 15, wherein when said back plate moves away from said bracket, said first bias and said second bias increase, and when said back plate moves closer to said bracket, said first bias and said second bias decrease.

19. The system as recited in claim 15, wherein the movement of said back plate relative to said bracket changes the relative position of said first and second holder relative to said front side of said bracket.

20. The system as recited in claim 15, wherein said first spring and said second spring have different spring rates, such that as the yarn passes between said first disk and said second disk of said first pair of disks, the pressure applied to the yarn by said first spring is less than the pressure applied to the yarn by said second spring when the yarn passes between said first disk and said second disk of said second pair of disks.

* * * * *